US009809041B1

(12) United States Patent
Lin

(10) Patent No.: US 9,809,041 B1
(45) Date of Patent: Nov. 7, 2017

(54) INKJET PRINTER INCLUDING AN ADJUSTABLE PRINTER HEAD AND RELEVANT PRINTING SYSTEM

(71) Applicant: HON HAI PRECISION INDUSTRY CO., LTD., New Taipei (TW)

(72) Inventor: Hui-Huang Lin, New Taipei (TW)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 0 days.

(21) Appl. No.: 15/243,929

(22) Filed: Aug. 22, 2016

(30) Foreign Application Priority Data

Jul. 14, 2016 (CN) ..... 2016 1 0553490

(51) Int. Cl.

| | |
|---|---|
| ***B41J 2/14*** | (2006.01) |
| ***B41J 2/16*** | (2006.01) |
| ***B41J 25/00*** | (2006.01) |
| ***B41J 2/145*** | (2006.01) |

(52) U.S. Cl.
CPC ..... *B41J 25/001* (2013.01); *B41J 2/145* (2013.01)

(58) Field of Classification Search
CPC ..... B41J 25/001; B41J 25/304; B41J 25/308; B41J 25/316; B41J 25/3082; B41J 25/3086; B41J 11/008
See application file for complete search history.

(56) References Cited

U.S. PATENT DOCUMENTS 4,657,417 A * 4/1987 Kikuchi ..... B41J 25/316 400/120.17
6,579,019 B2 * 6/2003 Ansell ..... B41J 19/14 101/71

* cited by examiner

*Primary Examiner* — Juanita D Jackson
(74) *Attorney, Agent, or Firm* — Steven Reiss

(57) ABSTRACT

An inkjet printer which is finely adjustable as to elevation above a printing medium includes an inkjet head and an adjustment module. The adjustment module includes a magnetic track, a platen, and two electromagnetic elements. The platen supports the printing medium and the two electromagnetic elements are coupled to a power source. The two electromagnetic elements can slide in the magnetic track, and are moveable relative to the magnetic track in a direction perpendicular to the printing medium, to adjust a distance between the inkjet head and the printing medium. A printing system is also provided.

18 Claims, 5 Drawing Sheets

INKJET PRINTER INCLUDING AN ADJUSTABLE PRINTER HEAD AND RELEVANT PRINTING SYSTEM

FIELD

The subject matter herein generally relates to an inkjet printer and a printing system.

BACKGROUND

An inkjet printer jets ink onto a printing medium to print a picture. A distance between a inkjet head and the printing medium should be kept at a constant level, so as to optimize a printing quality. When the above distance becomes smaller, the ink jet range is shortened, a greater number of pixels can be printed on the same area, and a better picture quality is achieved. Conversely, if the distance is enlarged, the printed pixels become smaller. When the distance gets too large, the shape of the pixel is deformed, and the quality of the printed picture will be degraded. Likewise, if the distance is too small, the printing quality may also be affected and the printer head module may track through and pick up wet ink on the printing medium.

BRIEF DESCRIPTION OF THE DRAWINGS

Implementations of the present technology will now be described, by way of example only, with reference to the attached figures.

DETAILED DESCRIPTION

Figure 1:
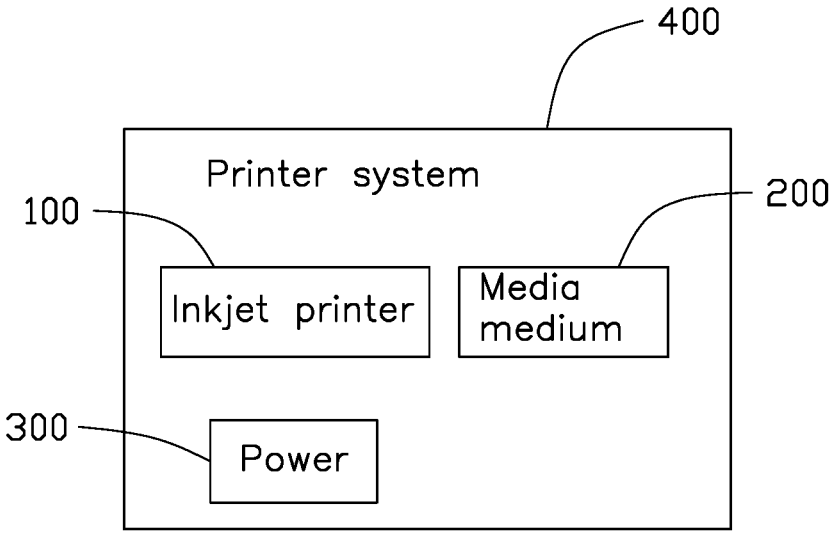
FIG. 1 is a block diagram of an embodiment of a printing system of the present disclosure.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. Also, the description is not to be considered as limiting the scope of the embodiments described herein. The drawings are not necessarily to scale and the proportions of certain parts may be exaggerated to better illustrate details and features of the present disclosure.

Several definitions that apply throughout this disclosure will now be presented.

The term "coupled" is defined as connected, whether directly or indirectly through intervening components, and is not necessarily limited to physical connections. The connection can be such that the objects are permanently coupled or releasably coupled. The term "comprising," when utilized, means "including, but not necessarily limited to"; it specifically indicates open-ended inclusion or membership in the so-described combination, group, series, and the like.

The disclosure will now be described in relation to a printing system.

FIG. 1 illustrates an embodiment of a printing system 400.

The printing system 400 comprises an inkjet printer 100, a media medium 200, and a power source 300. The inkjet printer 100 is configured to print onto the media medium 200. The power source 300 is configured to supply power to the inkjet printer 100.

In one embodiment, the media medium 200 can be a paper inkjet printer 100 used for any inkjet printing.

Figure 2:
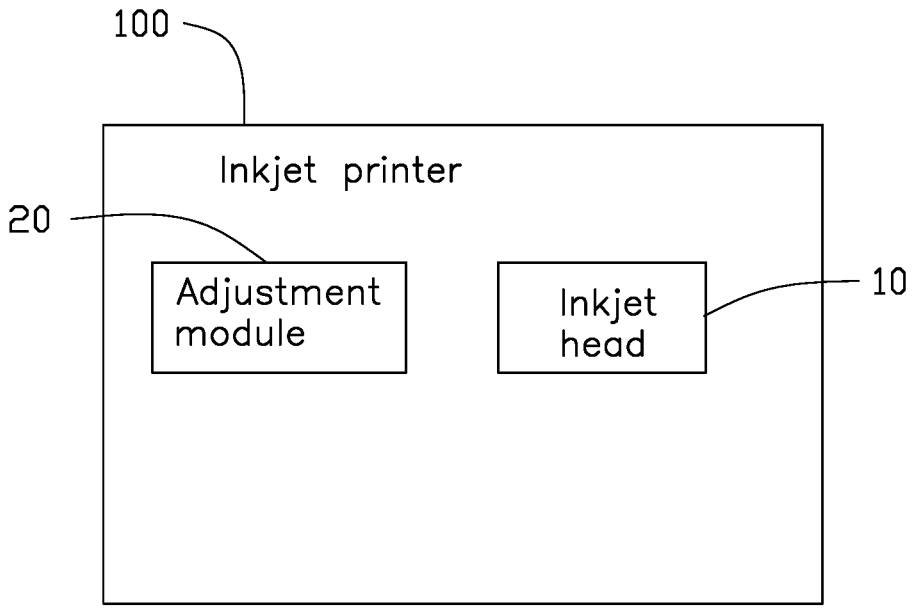
FIG. 2 is a block diagram of an embodiment of an inkjet printer of the present disclosure.

FIG. 2 illustrates an embodiment of the inkjet printer 100.

The inkjet printer 100 comprises an inkjet head 10 and an adjustment module 20. The inkjet head 10 is configured to jet out ink to the media medium 200. The adjustment module 20 is configured to adjust a distance between the inkjet head 10 and the media medium 200.

In one embodiment, an inkjet head is rectangular in cross section.

Figure 3:
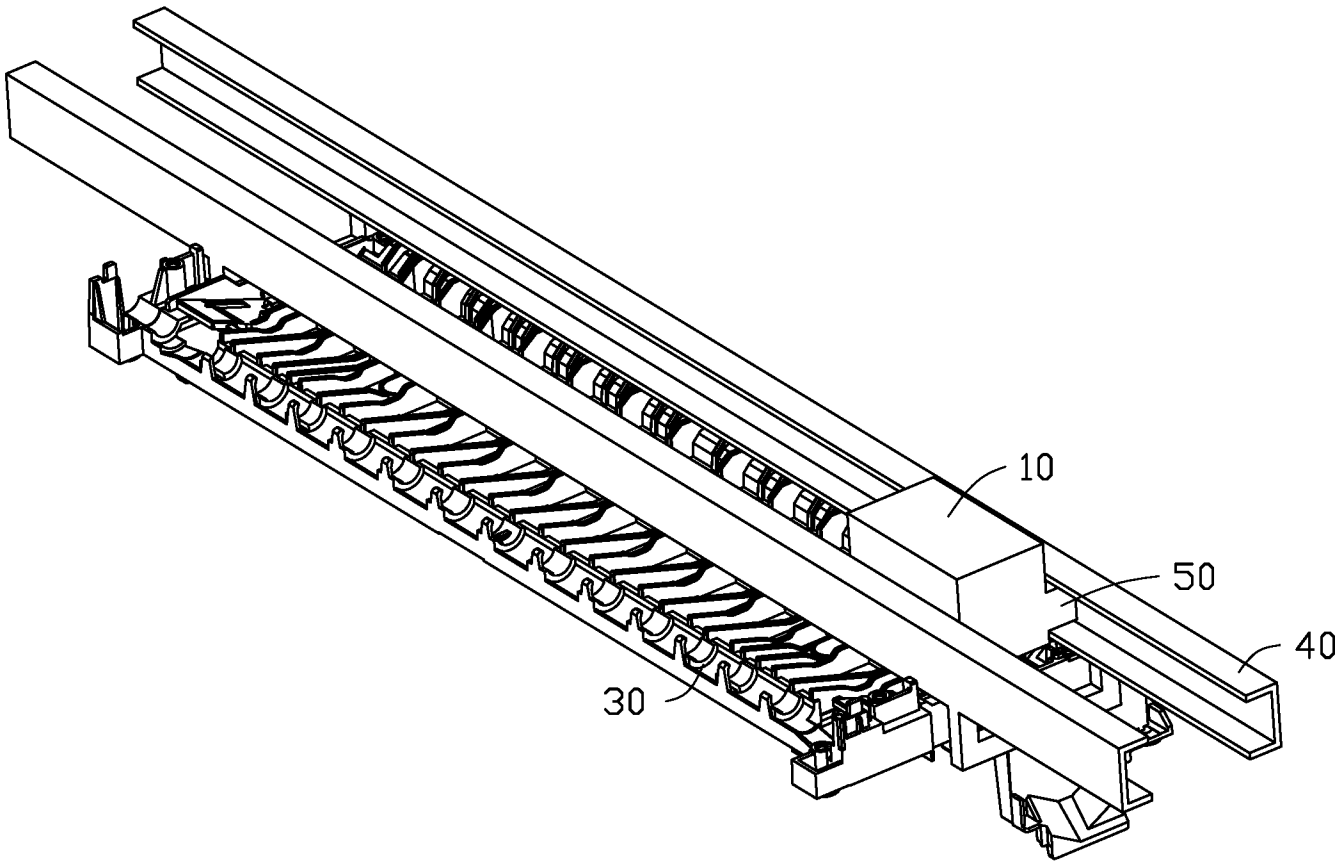
FIG. 3 is an assembled, isometric view of the inkjet printer of FIG. 2.
Figure 4:
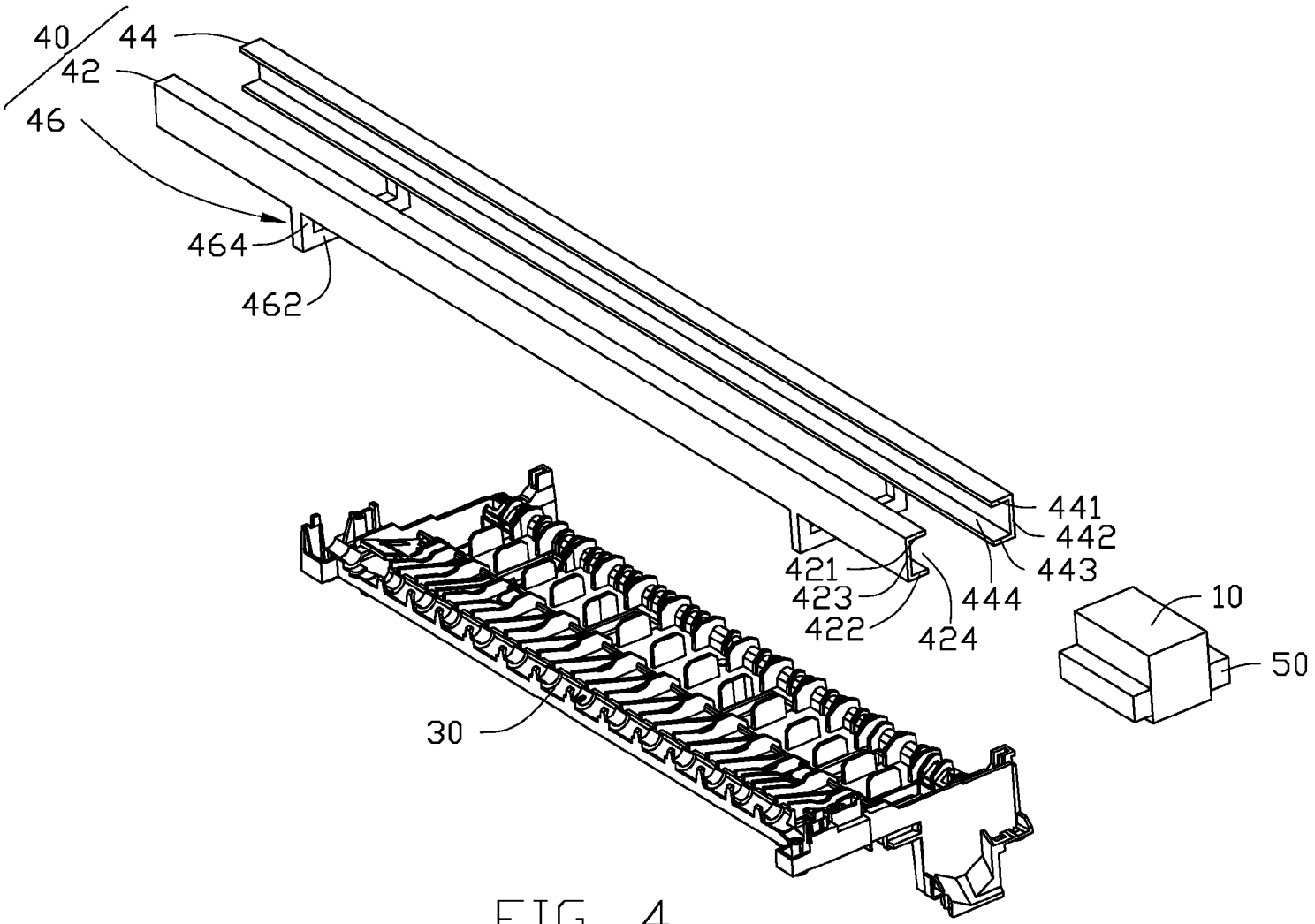
FIG. 4 is an exploded, isometric view of the inkjet printer of FIG. 2.

Referring to FIG. 3 and FIG. 4, the adjustment module 20 comprises a platen 30, a magnetic track 40, and two electromagnetic elements 50.

The platen 30 is configured to support the media medium 200. Thereby, a media medium printing surface is facing an inkjet head nozzle.

The magnetic track 40 comprises a first slide rail 42 and a second slide rail 44 and two support frames 46. The first slide rail 42 comprises a first top wall 421, a first bottom wall 422, and a first side wall 423. The first top wall 421, the first bottom wall 422, and the first side wall 423 form a first groove 424. The second slide rail 44 comprises a second top wall 441, a second bottom wall 442, and a second side wall 443. The second top wall 441, the second bottom wall 442, and the second side wall 443 form a second groove 444. The positions of the first groove 424 and the second groove 444 are fixed relative to each other.

The first top wall 421 and the second top wall 441 are in a first plane, the first bottom wall 422 and the second bottom wall 442 are in a second plane, and the first plane and the second plane are in parallel.

In one embodiment, the first slide rail 42 and the second slide rail 44 are magnetic bodies. The first slide rail 42 and the second slide rail 44 are configured to generate or react to a magnetic field.

The two support frames 46 have the same structure. Each of the two support frames 46 comprises a base arm 462 and two support arms 464. The two support arms 464 are respectively connected to the first bottom wall 422 and the second bottom wall 442.

The two electromagnetic elements 50 are mounted beside the inkjet head 10 and are parallel to each other. The two electromagnetic elements 50 are coupled to the power source 300 to receive power.

In one embodiment, the electromagnetic element 50 can be a electromagnet. A cross section of the electromagnetic element is rectangular.

Figure 5:
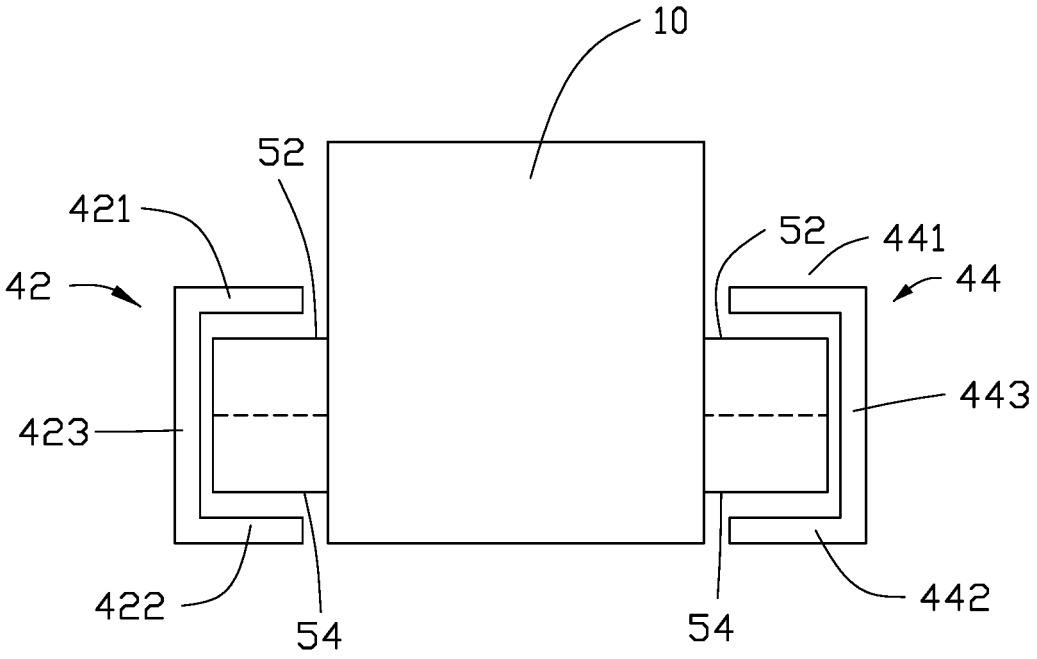
FIG. 5 is a front view of an inkjet head of the inkjet printer of FIG. 2 connected to a magnetic track.

Referring to FIG. 5, the electromagnetic element 50 comprises an electromagnetic element top half and an electromagnetic element bottom half. The power source 300 supplies power to the electromagnetic element top half and to the electromagnetic element bottom half. The electromagnetic element 50 further comprises an electromagnetic element upper surface 52 and an electromagnetic element lower surface 54. A distance between the electromagnetic element upper surface 52 and the electromagnetic element lower surface 54 is less than a distance between a first top wall lower surface and a first bottom wall upper surface. Thereby, the two electromagnetic elements 50 can loosely slip into the first groove 424 and the second groove 444, and the two electromagnetic elements 50 can move in the first groove 424 and the second groove 444.

The two support frames 46 are installed on the platen 30 and the inkjet head 10 is fixed between the two electromagnetic elements 50.

When the inkjet printer 100 is operating, the media medium 200 is put on the platen 30. The media medium printing surface faces the inkjet head nozzle. When an electrical current to the electromagnetic element bottom half is greater than an electrical current to the electromagnetic element top half, a magnetic repulsion between the electromagnetic element bottom half and the magnetic track 40 is greater than a magnetic repulsion between the electromagnetic element top half and the magnetic track 40. The two electromagnetic elements 50 lead the inkjet head 10 to move relative to the magnetic track 40 in a direction perpendicular to the media medium printing surface.

When a distance between the inkjet head 10 and the media medium printing surface is minimal, the inkjet printer 100 can increase the current to the electromagnetic element bottom half and decrease the current to the electromagnetic element top half. Thereby, the magnetic repulsion between the electromagnetic element bottom half and the magnetic track 40 is strengthened. The magnetic repulsion between the electromagnetic element top half and the magnetic track 40 is weakened, and the distance between the inkjet head 10 and the media medium printing surface is thereby increased.

When the distance between the inkjet head 10 and the media medium printing surface is greater or maximal, the inkjet printer 100 can decrease current to the electromagnetic element bottom half and increase current to the electromagnetic element top half. Thereby, the magnetic repulsion between the electromagnetic element bottom half and the magnetic track 40 is weakened. The magnetic repulsion between the electromagnetic element top half and the magnetic track 40 is strengthened, and the distance between the inkjet head 10 and the media medium printing surface is thereby decreased.

While the disclosure has been described by way of example and in terms of the embodiment, it is to be understood that the disclosure is not limited thereto. On the contrary, it is intended to cover various modifications and similar arrangements as would be apparent to those skilled in the art. Therefore, the range of the appended claims should be accorded the broadest interpretation so as to encompass all such modifications and similar arrangements.

What is claimed is:

1. An inkjet printer, comprising:
an inkjet head; and
an adjustment module, comprising:
a magnetic track;
a platen configured to support a media medium; and
two electromagnetic elements mounted on two sides of the inkjet head and being parallel to each other;
wherein the inkjet head is configured to jet out ink to the media medium; the two electromagnetic elements are coupled to a power source to receive power; and
when the two electromagnetic elements slid into the magnetic track, and the two electromagnetic elements are moveable relative to the magnetic track in a direction perpendicular to a media medium printing surface to adjust a distance between the inkjet head and the media medium according to an electrical current value of the power source.

2. The inkjet printer of claim 1, wherein the magnetic track is a magnetic body; each of the two electromagnetic elements comprises a electromagnetic element top half and a electromagnetic element bottom half; and when an electrical current to the electromagnetic element bottom half is greater than an electrical current to the electromagnetic element top half, a magnetic repulsion between the electromagnetic element bottom half and the magnetic track is greater than a magnetic repulsion between the electromagnetic element top half and the magnetic track, and the two electromagnetic elements lead the inkjet head to move relative to the magnetic track in a direction perpendicular to the media medium printing surface to increase the distance between the inkjet head and the media medium.

3. The inkjet printer of claim 2, wherein when the electrical current to the electromagnetic element bottom half is less than the electrical current to the electromagnetic element top half current value, the magnetic repulsion between the electromagnetic element bottom half and the magnetic track is less than the magnetic repulsion between the electromagnetic element top half and the magnetic track, and the two electromagnetic elements lead the inkjet head to move relative to the magnetic track in a direction perpendicular to the media medium printing surface to decrease the distance between the inkjet head and the media medium.

4. The inkjet printer of claim 1, wherein the magnetic track comprises a first slide rail and a second slide rail; the first slide rail comprises a first top wall, a first bottom wall, and a first side wall; the first top wall, the first bottom wall, and the first side wall form a first groove; the second slide rail comprises a second top wall, a second bottom wall, and a second side wall; the second top wall, the second bottom wall, and the second side wall form a second groove; and the first groove and the second groove are fixed relatively to each other.

5. The inkjet printer of claim 4, wherein the first top wall and the second top wall are in a first plane; the first bottom wall and the second bottom wall are in a second plane; and the first plane and the second plane are in parallel.

6. The inkjet printer of claim 5, wherein the magnetic track further comprises two support frames; each of the two support frames comprises a base arm and two support arms; and the two support arms are respectively connected to the first bottom wall and the second bottom wall.

7. The inkjet printer of claim 6, wherein a cross sectional of the inkjet head is rectangular.

8. The inkjet printer of claim 5, wherein the electromagnetic element further comprises a electromagnetic element upper surface and a electromagnetic element lower surface; and a distance between the electromagnetic element upper surface and the electromagnetic element lower surface is less than a distance between a first top wall lower surface and a first bottom wall upper surface.

9. The inkjet printer of claim 1, wherein the media medium is a paper.

10. A printing system, comprising:
a media medium; and
an inkjet printer, comprising:
an inkjet head; and
an adjustment module, comprising:
a magnetic track;
a platen configured to support a media medium; and
two electromagnetic elements mounted on two sides of the inkjet head and being parallel to each other;

wherein the inkjet head is configured to jet out ink to the media medium; the two electromagnetic elements are coupled to a power source to receive power; and when the two electromagnetic elements slid into the magnetic track, and the two electromagnetic elements are moveable relative to the magnetic track in a direction perpendicular to a media medium printing surface to adjust a distance between the inkjet head and the media medium according to an electrical current value of the power source.

11. The printing system of claim 10, wherein the magnetic track is a magnetic body; each of the two electromagnetic elements comprises a electromagnetic element top half and a electromagnetic element bottom half; and when an electrical current to the electromagnetic element bottom half is greater than an electrical current to the electromagnetic element top half, a magnetic repulsion between the electromagnetic element bottom half and the magnetic track is greater than a magnetic repulsion between the electromagnetic element top half and the magnetic track, and the two electromagnetic elements lead the inkjet head to move relative to the magnetic track in a direction perpendicular to the media medium printing surface to increase the distance between the inkjet head and the media medium.

12. The printing system of claim 11, wherein when the electrical current to the electromagnetic element bottom half is less than the electrical current to the electromagnetic element top half current value, the magnetic repulsion between the electromagnetic element bottom half and the magnetic track is less than the magnetic repulsion between the electromagnetic element top half and the magnetic track, and the two electromagnetic elements lead the inkjet head to move relative to the magnetic track in a direction perpendicular to the media medium printing surface to decrease the distance between the inkjet head and the media medium.

13. The printing system of claim 10, wherein the magnetic track comprises a first slide rail and a second slide rail; the first slide rail comprises a first top wall, a first bottom wall, and a first side wall; the first top wall, the first bottom wall, and the first side wall form a first groove; the second slide rail comprises a second top wall, a second bottom wall, and a second side wall; the second top wall, the second bottom wall, and the second side wall form a second groove; and the first groove and the second groove are fixed relatively to each other.

14. The printing system of claim 13, wherein the first top wall and the second top wall are in a first plane; the first bottom wall and the second bottom wall are in a second plane; and the first plane and the second plane are in parallel.

15. The printing system of claim 14, wherein the magnetic track further comprises two support frames; each of the two support frames comprises a base arm and two support arms; and the two support arms are respectively connected to the first bottom wall and the second bottom wall.

16. The printing system of claim 15, wherein a cross sectional of the inkjet head is rectangular.

17. The printing system of claim 14, wherein the electromagnetic element further comprises a electromagnetic element upper surface and a electromagnetic element lower surface; and a distance between the electromagnetic element upper surface and the electromagnetic element lower surface is less than a distance between a first top wall lower surface and a first bottom wall upper surface.

18. The printing system of claim 10, wherein the media medium is a paper.

* * * * *